US005533672A

United States Patent [19]

Peters

[11] Patent Number: 5,533,672

[45] Date of Patent: Jul. 9, 1996

[54] DUAL EVENT NOZZLE FOR LOW OPENING AND HIGH CLOSING PRESSURE INJECTOR

[75] Inventor: Lester L. Peters, Columbus, Ind.

[73] Assignee: Cummins Engine Company, Inc., Columbus, Ind.

[21] Appl. No.: 301,345

[22] Filed: Sep. 6, 1994

[51] Int. Cl.[6] ..... F02M 47/02

[52] U.S. Cl. ..... 239/88; 239/124

[58] Field of Search ..... 239/88–96, 124, 239/125; 123/467, 446

[56] References Cited

U.S. PATENT DOCUMENTS

| | | | |
|---|---|---|---|
| 2,813,752 | 11/1957 | Pringham | 239/91 |
| 3,257,078 | 6/1966 | Mekkes | 239/90 |
| 4,272,027 | 6/1981 | Seilly et al. | 239/88 |
| 4,425,894 | 1/1984 | Kato et al. | 123/446 |
| 4,467,963 | 8/1984 | Sisson et al. | 239/90 |
| 4,494,696 | 1/1985 | Schneider | 239/90 |
| 4,538,576 | 9/1985 | Schneider | 239/88 X |
| 4,605,166 | 8/1986 | Kelly | 239/96 |
| 4,641,784 | 2/1987 | Howes | 239/453 |
| 4,911,127 | 3/1990 | Perr | 123/446 |
| 4,969,600 | 11/1990 | Nicol | 239/88 |
| 5,094,397 | 3/1992 | Peters et al. | 239/88 |
| 5,275,337 | 1/1994 | Kolarik et al. | 239/91 |

OTHER PUBLICATIONS 5,096,121; Grinsteiner; Published Mar. 17, 1992; Grant Withdrawn.

*Primary Examiner*—Andres Kashnikow
*Assistant Examiner*—Lesley D. Morris
*Attorney, Agent, or Firm*—Woodard, Emhardt, Naughton Moriarty & McNett

[57] ABSTRACT

In a closed-nozzle fuel injector, an injection timing chamber and an injection chamber and a metering plunger/valve moving in a bore between them. A passage from the injection chamber to the injection spray ports is closed by a needle valve. A piston cup seats one end of a needle valve closing spring, the other end being seated on the needle timing spill passageway is opened by a metering plunger and spills fuel from the injector timing chamber to drive an injection needle-valve-spring-loading-piston away from a rest position toward the spring seat on the valve and apply additional force on the valve-closing-spring at the end of injection. In one embodiment, a passageway from the space above the spring-loading piston to a drain line has an orifice therein to maintain pressure atop the piston to hold the valve closed long enough for combustion pressure in the cylinder to drop before return of the spring seat piston to original rest position. In another embodiment, a ring valve is used, rather than the orificed passageway, to control the rate of spill and thereby maintain pressure for the needed duration. In both embodiments, travel of the piston in a spring loading direction is limited by an abutment shoulder to limit total maximum closing force of the needle valve on the valve seat. Other embodiments positively vent the injection chamber through a restricted passageway to drain during timing fuel spill, for decompression of injection fuel in the injector at the end of injection.

18 Claims, 9 Drawing Sheets

DUAL EVENT NOZZLE FOR LOW OPENING AND HIGH CLOSING PRESSURE INJECTOR

BACKGROUND OF THE INVENTION

1. Field of the Invention

This invention relates generally to fuel injection for diesel engines and more particularly to a closed nozzle injector to provide different opening and closing pressures.

2. Description of the Prior Art

In fuel injectors having valve-closed nozzles, it is necessary to prevent combustion product reverse flow into the injector as a result of high cylinder pressure. A sharp end Lo the injection event can be helpful in this regard. Where a valve-closing return spring is used to close a needle valve in the injector, for example, if the spring force is high enough to close the valve against cylinder pressure to prevent admitting combustion products during combustion in a cylinder, it is higher than desirable to permit opening of the valve at a desirable nozzle opening pressure (NOP) for some operating conditions, particularly low load/idle. Negative consequences of a higher than desirable NOP include: a) a fueling curve "knee" characteristic whereby injected fueling relative to desired fueling sharply falls to zero at low load fuelings, a characteristic that leads to hot engine idle instability and cylinder power balance degradation; b) higher than desirable fuel injection rates at low idle, resulting in more pre-mixed combustion and resultant NOx formation and noise generation.

For low emissions engines, it is desirable to slow down the rate of fuel injection at the beginning of the injection event, and to make the end of injection faster or sharper. Therefore, it is desirable to provide a low NOP but a high nozzle closing pressure (NCP). U.S. Pat. No. 4,911,127 to Perr discloses an injector which has a pilot plunger 62 and a downwardly opening pilot piston 66 serving as the upper seat of a valve closing spring 86. In U.S. Pat. No. 4,605,166, a check valve 78 under control chamber 58 has a downwardly opening seat for the needle valve closing spring 80. At the end of injection, the pressure in the control chamber 58 and the bias force of spring 80 are said to exceed the lower residual pressure in the accumulator chamber 86 to rapidly reseat the valve needle.

It remains desirable to minimize wear on valve needles and seats and to minimize complexity of injectors in general, while achieving the object of a nozzle opening pressure considerably lower at the start of injection than is the closing pressure at the end of injection.

SUMMARY OF THE INVENTION

Described briefly, according to a typical embodiment of the present invention, an injector assembly is provided with a cup shaped piston serving as the seat at one end of a needle valve closing spring, the other end of the spring being seated on the needle valve. A timing spill passageway communicates between the metering plunger receiving bore in the metering barrel and a spring loading hydraulic chamber at the bottom of the barrel immediately above the valve spring seat piston. As the metering plunger bottoms out at the end of injection, it uncovers the entrance to this spill passageway and admits spill fuel from the timing chamber to the area above the spring seat piston to apply spill fuel pressure and drive the piston down onto a stop, thereby increasing the force of the valve closing spring at the end of injection. In one embodiment, a passageway from the spring loading chamber to drain has an orifice therein to restrict spill fuel flow out of the chamber to drain and thereby maintains pressure atop the spring seat piston to hold the needle valve closed long enough for combustion pressure in the cylinder to drop before return of the spring seat piston to its original position. In another embodiment, a ring valve is used to control spill pressure dissipation, to achieve the desired duration of needle valve closing pressure. Travel of the spring seat piston in the spring loading direction is limited by the aforementioned stop to limit total maximum closing force of the needle valve spring on the valve seat.

DESCRIPTION OF THE PREFERRED EMBODIMENT

Figure 1:
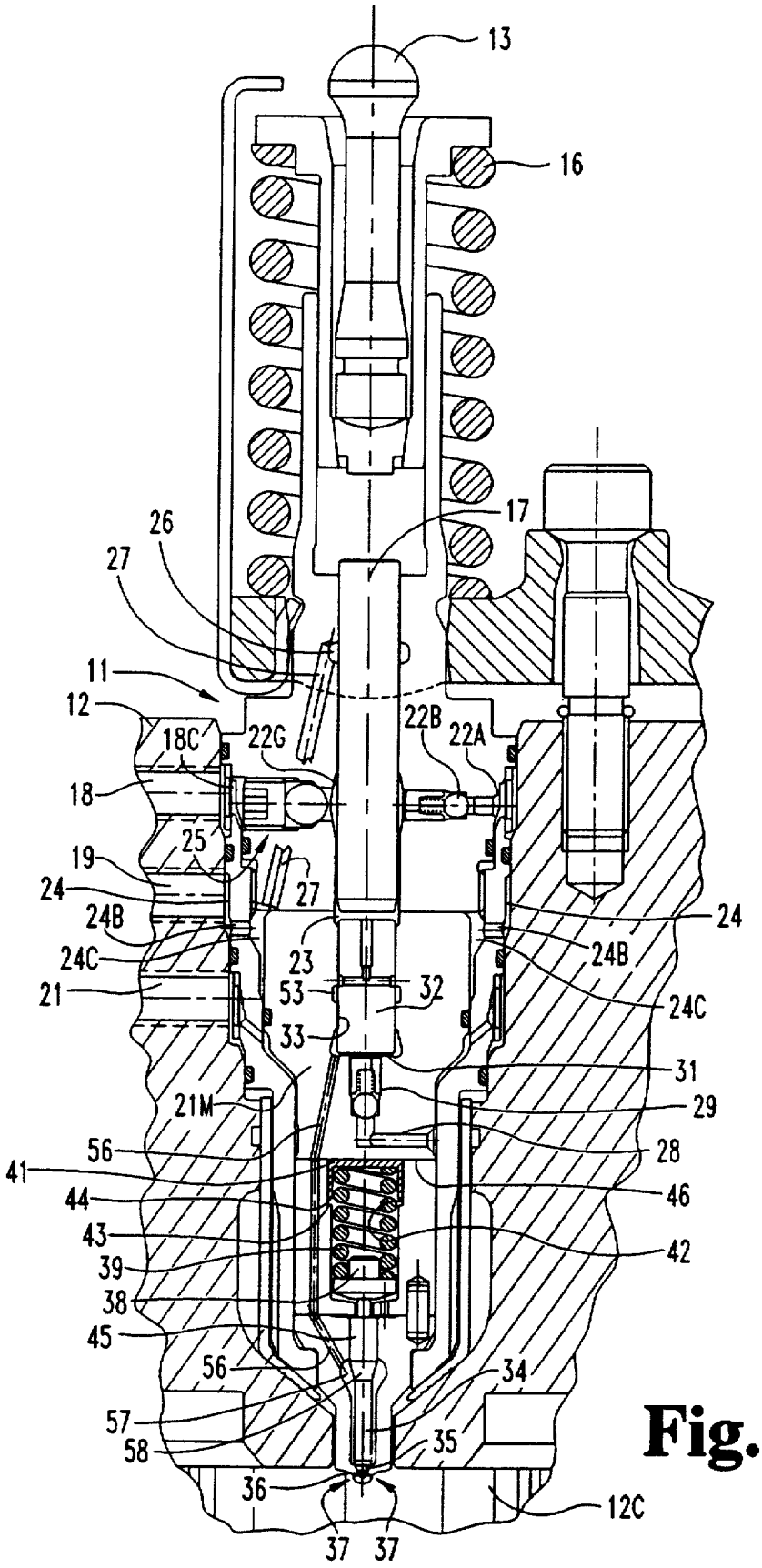
FIG. 1 is a longitudinal sectional schematic view of a injector assembly according to a typical embodiment of present invention at the start of metering fuel into it.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, a fuel injector assembly 11 is secured in the cylinder head 12 for injection of fuel into cylinder 12C. The injector, typically one for each cylinder of a multi-cylinder engine, is operated by a pushrod 13 driven by a cam driven rocker arm (not shown). The pushrod is held in its normal rest position as shown in FIG.

1 by return spring 16. The pushrod is operable by the rocker arm in a downward direction to drive the timing plunger 17.

Three passageways 18, 19 and 21 serve the injector assembly for timing fuel, drain, and fuel supply purposes, respectively. The timing fuel enters the injector assembly from passageway 18 into circumferential channel 18C around the injector body to port 22A and through spring loaded check valve 22B and into the shallow annular groove 22G in the injector body wall, and from there down through the clearance 22H (about 0.3 mm) between the timing plunger 17 and the bore of the injector body and from there into the timing chamber 23.

The drain passageway 19 to the engine fuel system, and which is not pressurized, serves the annular chamber 24 which communicates through ports 24B to annular chamber 24C. Plunger 17 is closely fitted to the injector body bore above groove 22G to avoid upward leakage there. But annular groove 26 receives any leakage which might occur, and it passes from groove 26 down drain passageway 27 to the drain system 24C, 24B, 24, 19. In the drawings, passageway 27 is shown broken to avoid confusion with the plug and set screw 25 which close a processing hole aligned with the check valve assembly 22B.

The fuel for injection is supplied from passageway 21 and is admitted at 21A down around the metering barrel and plunger assembly 21M and through the passageway 28 and ball check valve 29 to the injection chamber 31. Metering plunger 32 in bore 33 separates the timing chamber 23 from the injection chamber 31.

Figure 1A:
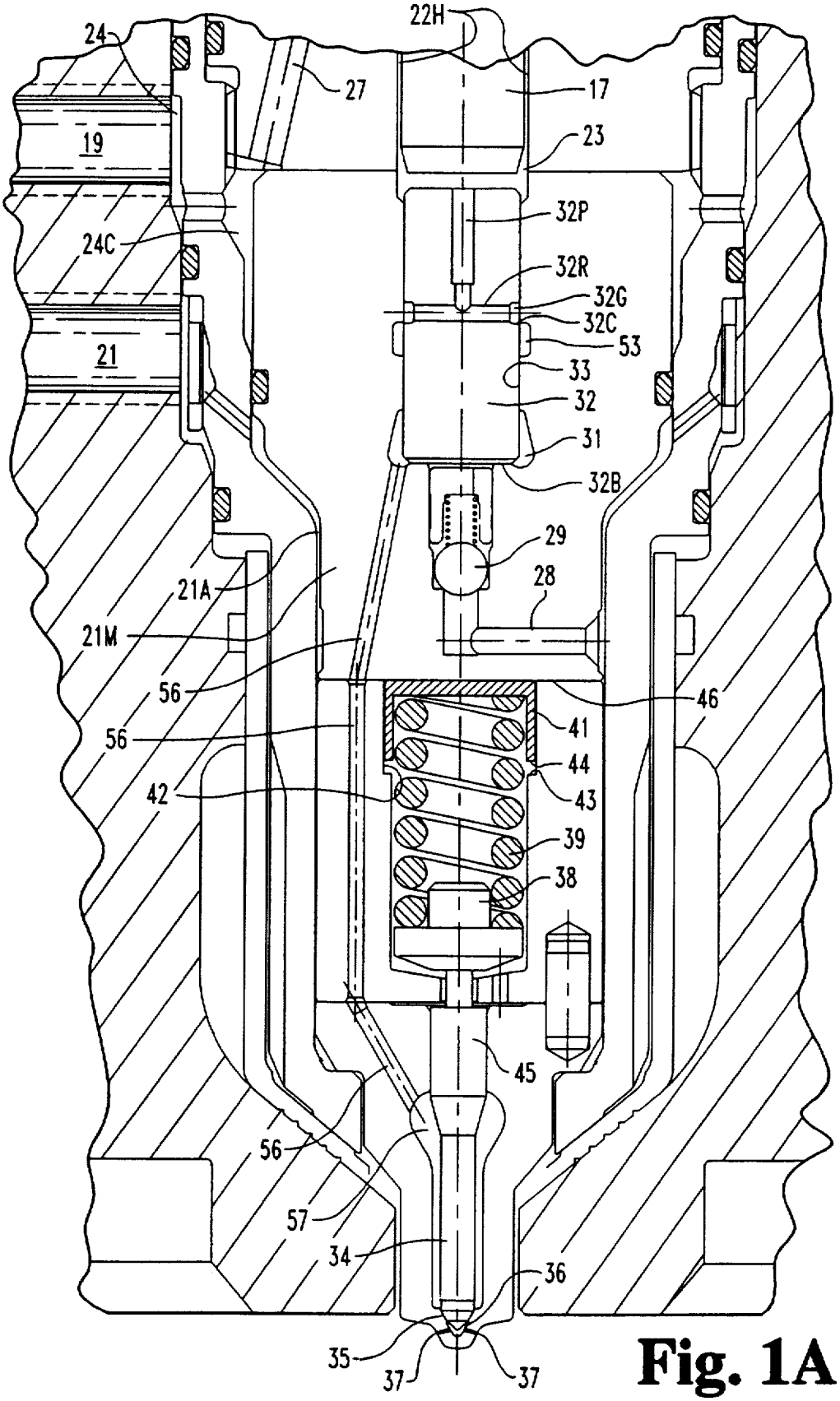
FIG. 1A is an enlargement of the lower portion of the assembly.

Referring to FIG. 1A, the needle valve 34 is normally closed on seat 35 near the lower tip of the injector immediately above the sac volume 36 which is immediately above the spray injection ports 37. The upper end of the needle valve has a boss 38 surrounded by the spring seat shoulder on which the lower end of the valve closing spring 39 is seated. The upper end of spring 39 is seated in the downwardly-opening, cup-shaped spring guide and seating piston 41 fittingly and slidably received in the bore 42. The bore 42 is stepped, providing a stop shoulder at 43 abuttingly engageable by the lower edge 44 of the spring seat piston skirt according to one feature of the invention. The needle valve shaft 45 is closely (100 millionths of an inch diametrical clearance) but slidably fitted in the needle valve guide base of the injector. A downwardly facing wall 46 in the injector body serves as the upper stop of the spring seat piston 41.

Figure 2:
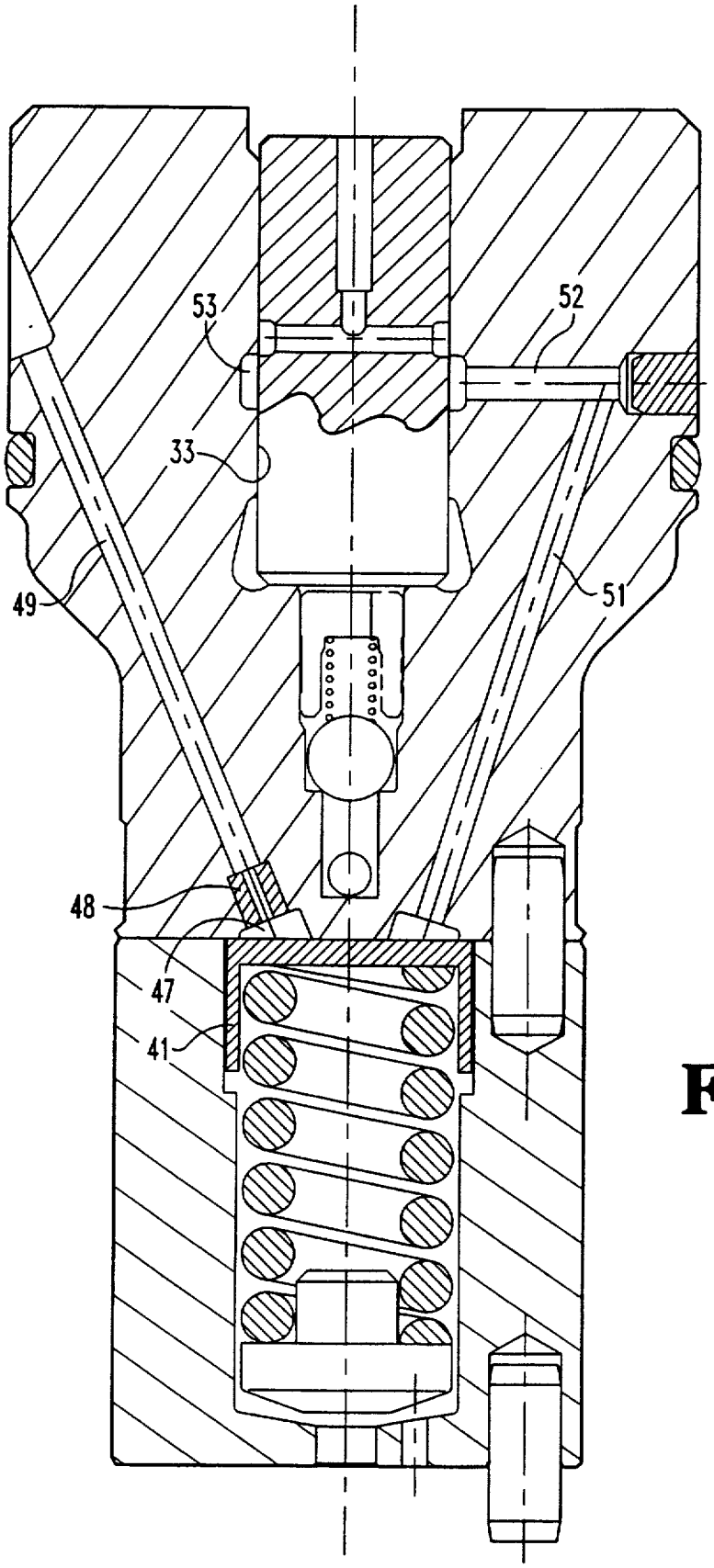
FIG. 2 is a view on the same scale as FIG. 1 but showing only a portion thereof viewed at a cutting plane 90 degrees around the injector axis from that of FIG. 1, to show fuel spill passageways.

Referring to FIG. 2, according to another feature of the invention, a passageway including an entrance portion 47, restriction portions shown as orifice 48 and exit portion 49 is provided and communicates with the top of the piston 41.

Referring further to FIG. 2, according to another feature of the invention, a timing spill passageway 51 communicates with the top of the spring seat piston 41. The upper end of this passageway opens into a lateral passageway 52 whose inner end communicates with the timing spill annular groove 53 in bore 33 wall 1.

Figure 3:
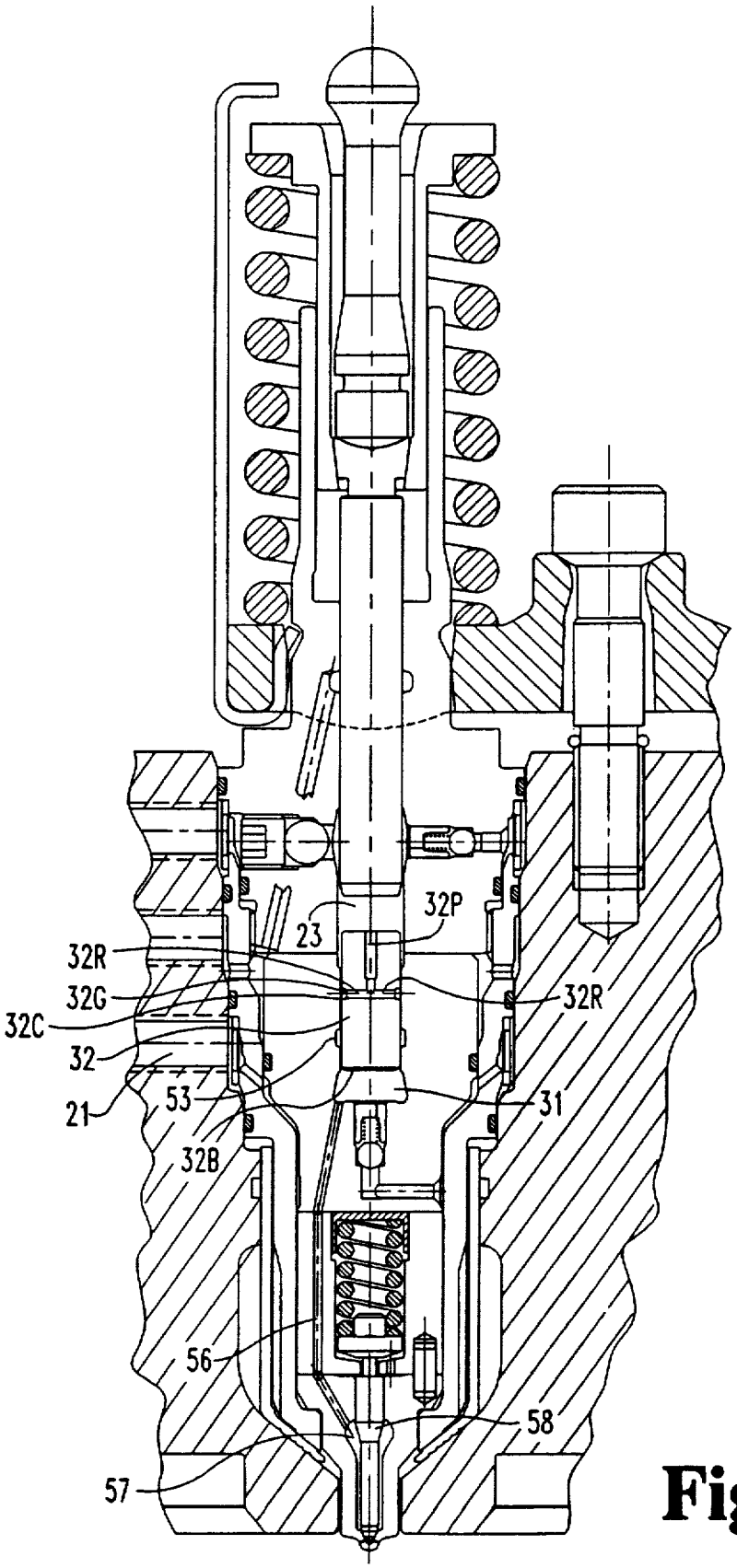
FIG. 3 is a view like FIG. 1 but showing the relationship of the parts after the metered fuel is in at the start of injection and injection is ready to commence.

Referring now to FIG. 3, while the engine fuel metering system has provided the desired amount of fuel through the timing fuel passageway 18 to the injector, it has pushed the timing plunger up to the position shown in FIG. 3. Simultaneously, the fuel supplied through port 21 for injection has pushed the metering plunger 32 to the position shown in FIG. 3, where it is held up by the pressure of fuel from the supply passageway 21. The timing spill groove 53 is closed by the wall of the metering plunger. The timing chamber 23 is full of timing fuel from the passageway 18. The passageway 56 from the injection chamber 31 through the injector body to the nozzle reservoir 57 and down around the needle to the valve seat 36 is full of fuel at the fuel supply pressure.

Figure 4:
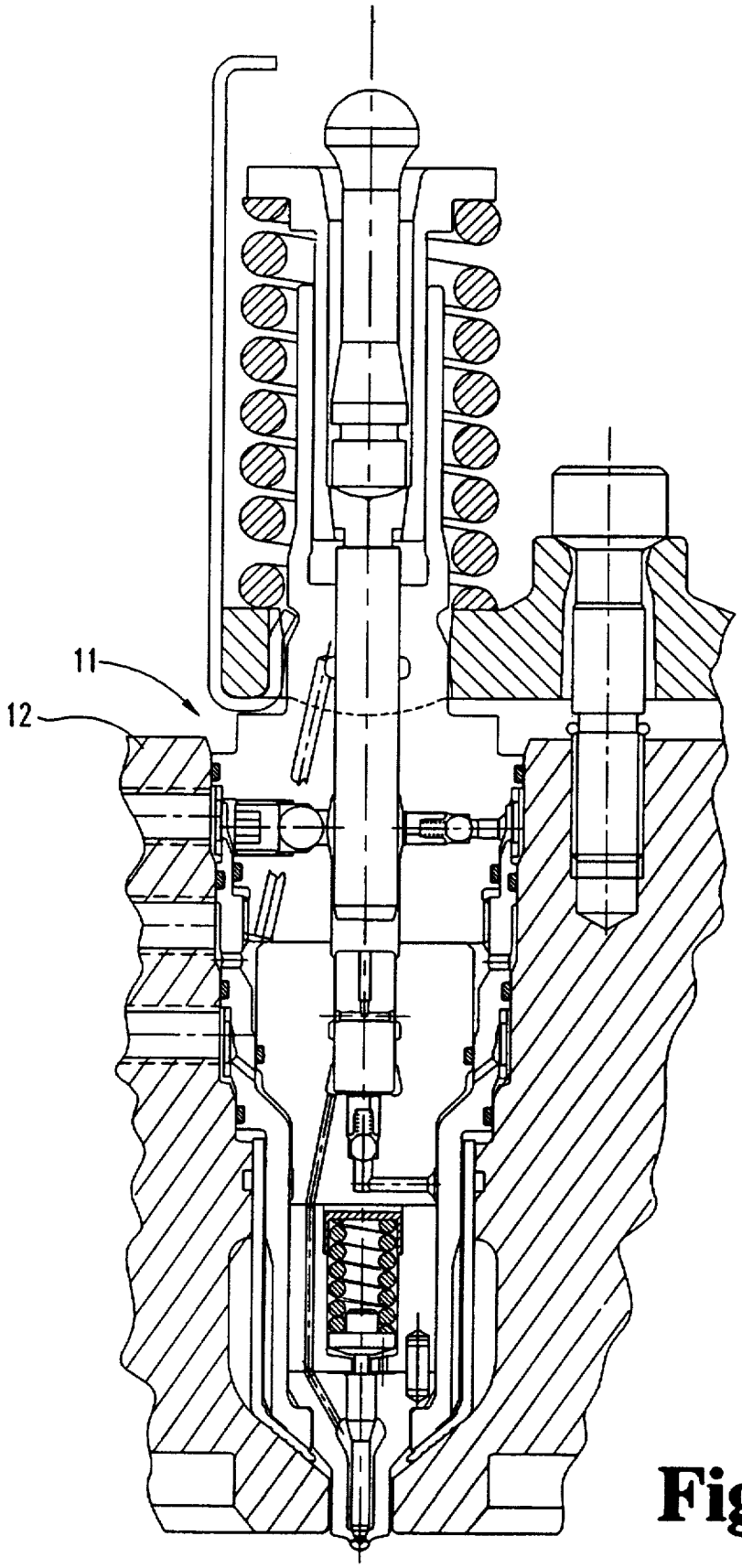
FIG. 4 is a view like FIG. 3 but showing the parts at the of injection and start of spill.

When the injector operating camshaft turns the cam to the injector activating position (pushrod lower end abutting the timing plunger upper end), the timing plunger 17 is driven downward which, due to the hydraulic lock between the timing plunger 17 and the metering plunger 32, drives the metering plunger 32 downward. As this occurs, the pressure in the injection chamber rises sufficiently to cause flow down passageway 56 and the pressure in the nozzle reservoir 57, operating on the difference between the area of the bore above step 58 on the needle valve and the area of the top of the needle seat, rises to compress spring 39 sufficiently to move the valve off the seat 35 to initiate injection of fuel into the cylinder. When the timing plunger has driven the metering plunger almost to the point of contact of the lower end 32B of the plunger with the bottom of the injection chamber, the leading edge 32C of the spill groove 32G in the metering plunger passes the upper edge of the spill groove 53 in the metering plunger bore 33 (FIG. 4, and 1A) whereupon timing fuel spills from the timing chamber 23 through the axial passageway 32P and intercepting radial passageways 32R in metering plunger, into and around the spill groove 32G, into spill groove 53 and out through passages 52 and 51 in the injector body. This causes a pressure rise in the timing spill fuel remaining in passageway 51 from the previous injection whereupon the pressure drives the spring seat piston 41 downward against the shoulder 43 (FIG. 1A), raising the spring force to close the needle valve during the combustion occurring in the cylinder. At the same time, however, the spilled fuel begins to pass upward through port 47 (FIG. 2), orifice 48 and passageway 49 in the injector body to drain chamber 24C. Since the metering plunger has bottomed out, injection pressure in passageway 56 and reservoir 57 begins to drop.

The seating of the piston 41 on the shoulder 43 limits the maximum force that can be applied to the needle valve and thus avoids undue wear or damage to the valve and seat. At the same time, however, it raises the force on the needle valve sufficiently to close the needle against pressures of the combustion process. According to the present invention, the pressure (NOP) in nozzle reservoir 57 necessary to open the valve is about 3,000 psi. Normally, in the absence of the present invention, and due to the increase in needle valve area against which pressure from reservoir 57 can act when the needle valve opens, the closing pressure (NCP) of the valve would then be 2,100 psi. Due to the application of spill pressure to piston 41, the pressure (NCP) necessary to close the needle valve after the spill has begun is increased to 3,500 psi. Consequently, once the spill has begun and the metering plunger has bottomed, the inability to supply more fuel down passageway 56, will permit pressure in nozzle reservoir 57 to drop, disabling it from keeping the needle valve open. Thus the needle valve will shut quickly and securely. Moreover, considering the small area of the needle valve seat 35, combustion pressure in the cylinder will be unable to reopen the valve. The orifice 48 in spill passageway 49 assures that-the spill pressure atop piston 41 will be adequate in amount and duration for the ultimate intended purpose of sharp and reliable closing of the needle valve.

Figure 5:
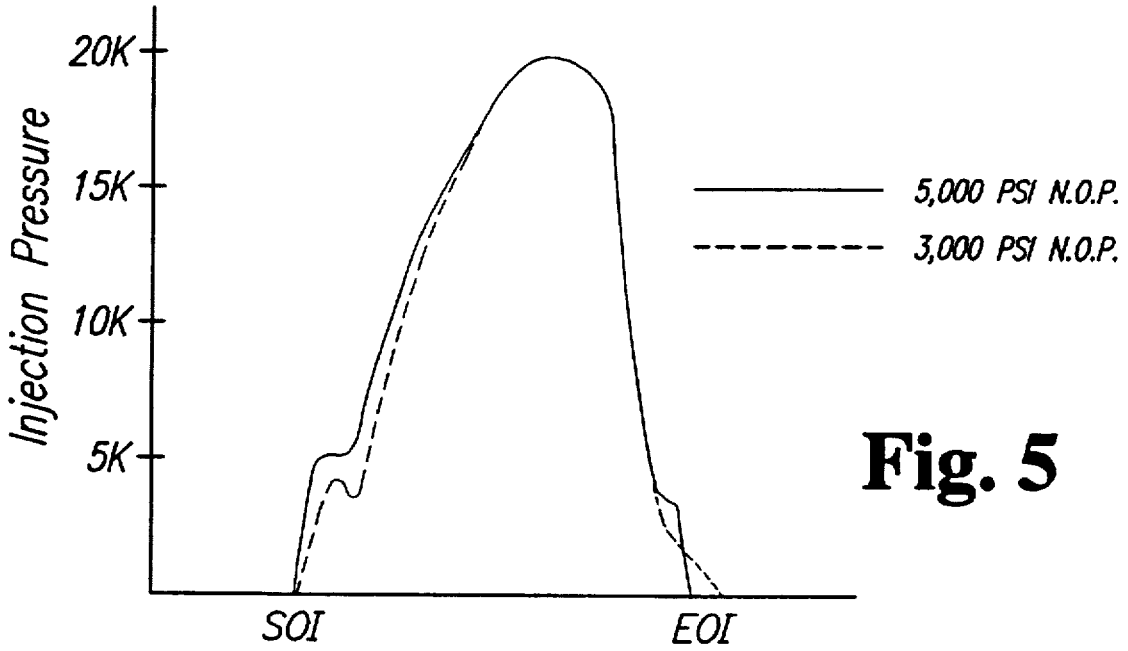
FIG. 5 is a graph of the injection pressure curve through a range of crank angles from start of injection to end of injection for injectors which have different nozzle opening pressures but are otherwise identical.

Referring now to FIG. 5, there is shown a graph of injection pressure expected at various crankshaft positions, with the commencement of the curves at the point of the start of injection (SOI) and at the end of injection (EOI). The solid line curve represents the sharp beginning and sharp ending of injection which would occur if the nozzle opening pressure were 5,000 psi and nozzle closing pressure were 3,500 psi (for example) as would be expected before implementation of the present invention. The dashed line represents the more gradual start and end of injection if nozzle opening pressure were at the lower and more desirable nozzle opening pressure (3,000 psi, for example) for a slower rate of fuel injection at the beginning of the injection event. However, with the practice of the present invention, the desirable slower rate of injection at the beginning, such as designated by the dashed line at the SOI point, but the quicker end-of-injection rate shown by the solid line at the EOI point on the graph, can be achieved.

Figure 6:
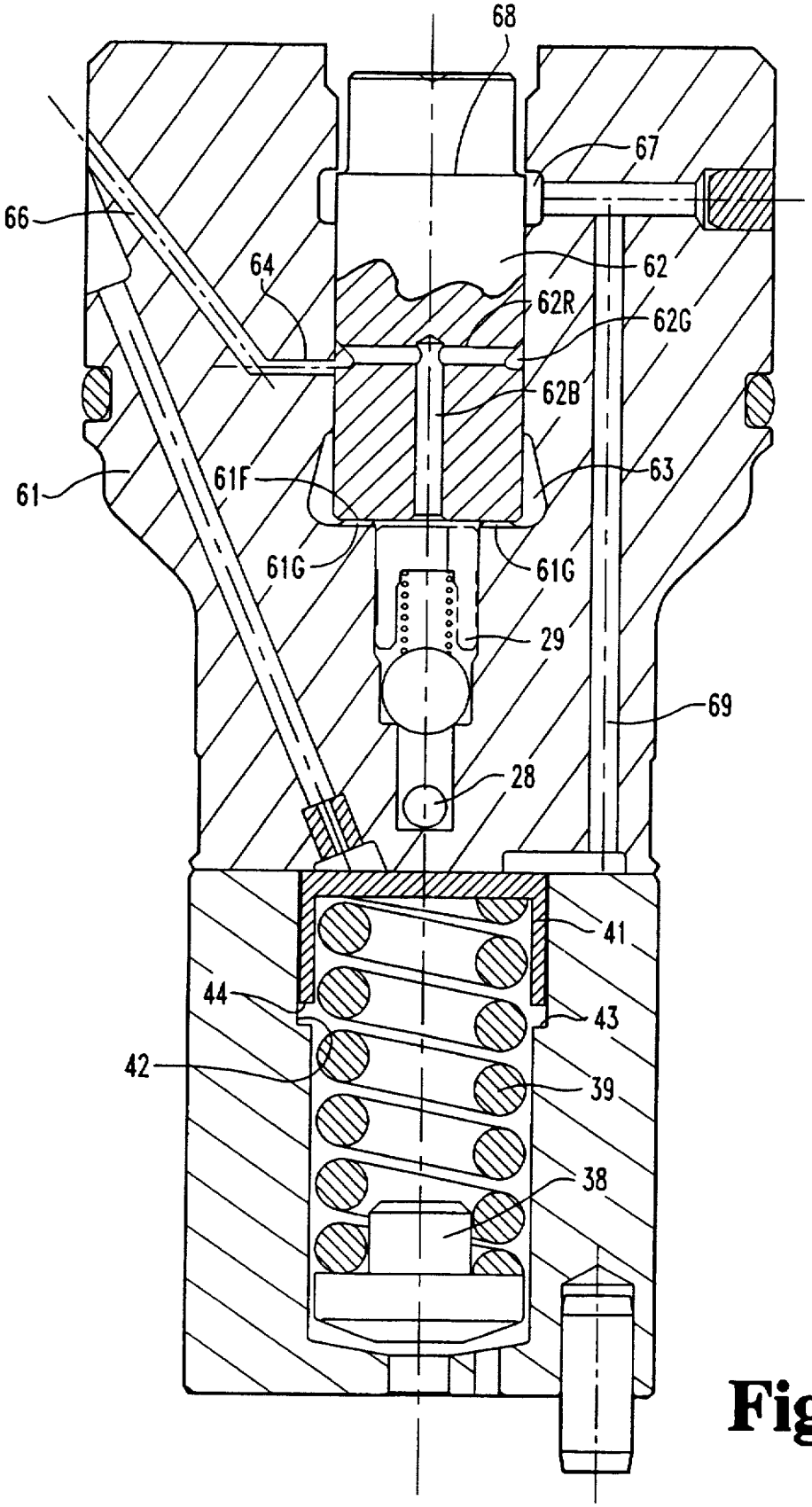
FIG. 6 is a view similar to FIG. 2 but disclosing an alternative construction for the metering barrel and plunger assembly for positive venting of the injection chamber upon fuel spill.

If a more rapid decay of pressure in passageway 56 and nozzle reservoir 57 is desired, an alternative embodiment of the metering barrel and plunger assembly is shown in FIG. 6. The configuration of the metering barrel 61 is similar to that previously described, and fuel for injection is supplied through passageway 28 and spring loaded ball check valve 29, but some other features are different. The metering plunger 62 is different in order to provide positive venting under that plunger when it has bottomed on the circular face 61F of the metering barrel at the bottom of the plunger receiving bore. This is achieved by two radial grooves 61G cut in face 61F and extending outward from the bore receiving the check valve seat 29 to the annular cavity 63 in the barrel. It is this cavity which communicates with the passageway 56 to reservoir 57 as better shown in FIG. 1A.

A central bore 62B extends up from the bottom of the metering plunger to transverse bore 62R communicating with the circumferential groove 62G. When the metering plunger has been driven to the bottom of its bore, the lower edge of the peripheral groove 62G opens the port 64 in the wall of the metering plunger bore and from which passageway 66 extends up to the outer wall of the metering barrel where it intercepts the annular chamber 24C (FIGS. 1 and 1A).

Another difference in the construction of the metering plunger and barrel is that, instead of having a groove in the plunger which intercepts a groove in the barrel and opens it for spill, the FIG. 6 embodiment includes only the groove 67 in the barrel and which is open to spill from the timing chamber when the step 68 of the metering plunger passes the upper edge of the groove 67. When this happens the fuel spilling from the timing chamber passes down through the internal passageway 69 to the top of the piston 41 to function in the same way as previously described. In addition, due to the available passageway through the metering plunger and the now-opened port 64 to the drain, the pressure in the passageway 56 and reservoir 57 can dissipate very quickly as the fuel compressed under the very high injection pressures expands. The port 64 being very small in diameter (0.60 mm, for example) and only partially opened does not permit enough flow to cause excessive pressure drop in the system from the metering chamber to the nozzle reservoir 57, but does enhance the sharp cut-off of the injection spray.

Figure 8:
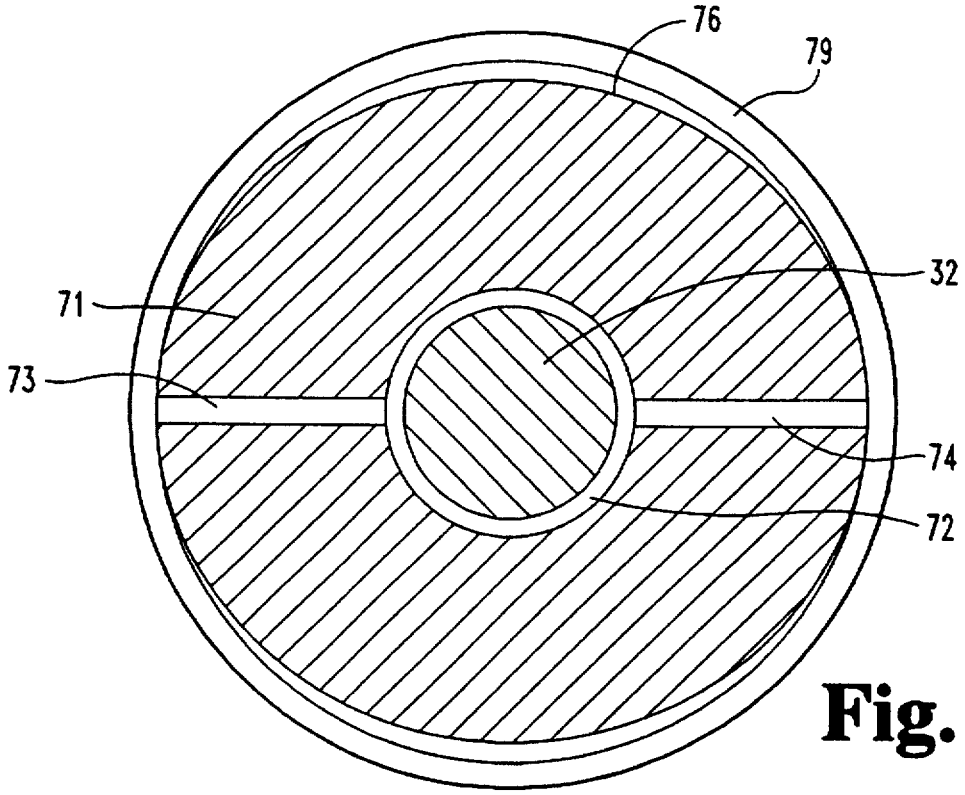
FIG. 8 is a section taken at line 8—8 in FIG. 7 and viewed in the direction of the arrows.
Figure 7:
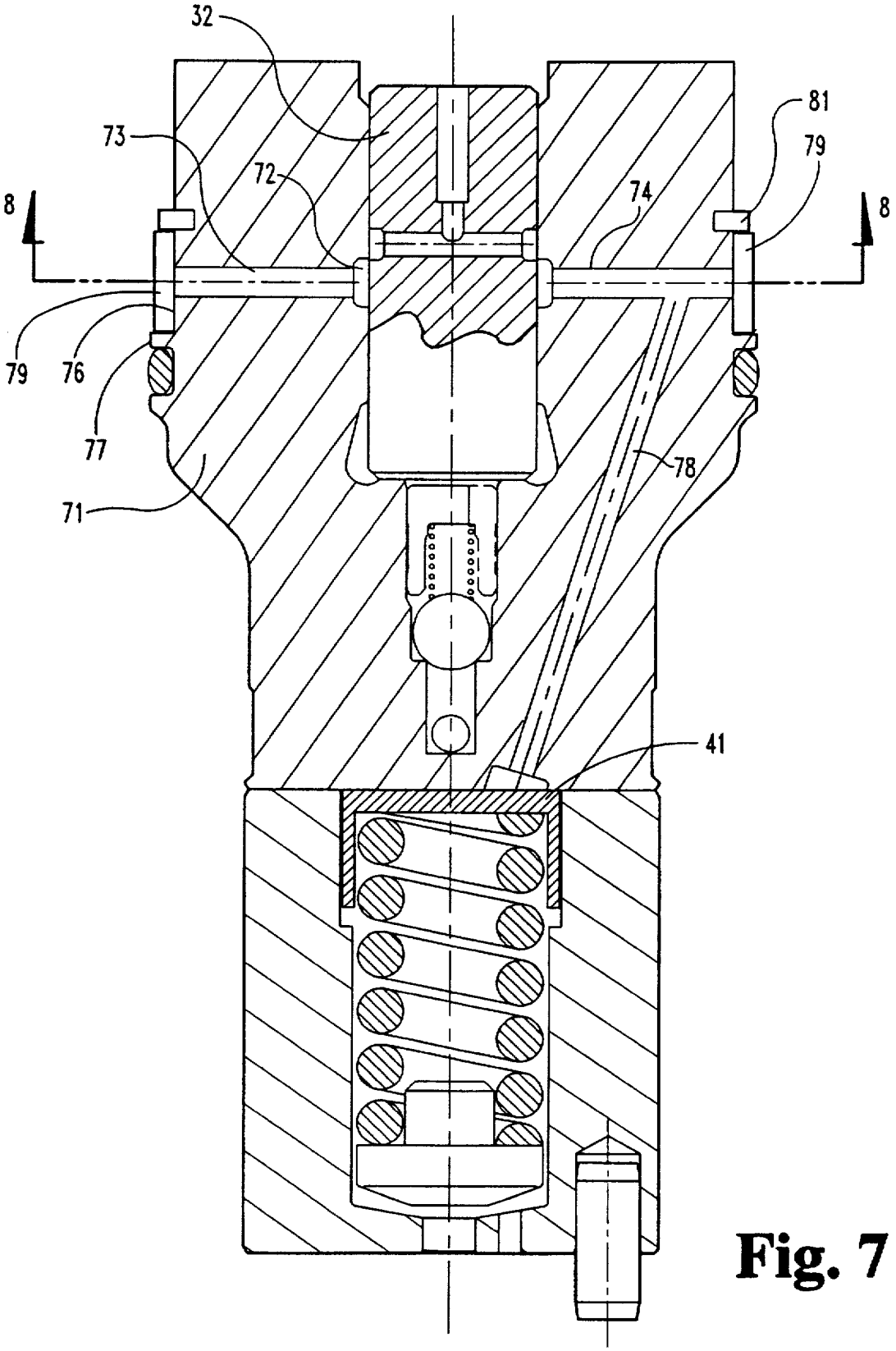
FIG. 7 is a view of a further embodiment of the metering barrel and plunger assembly employing a ring valve for spill instead of an orifice restriction.
Figure 9:
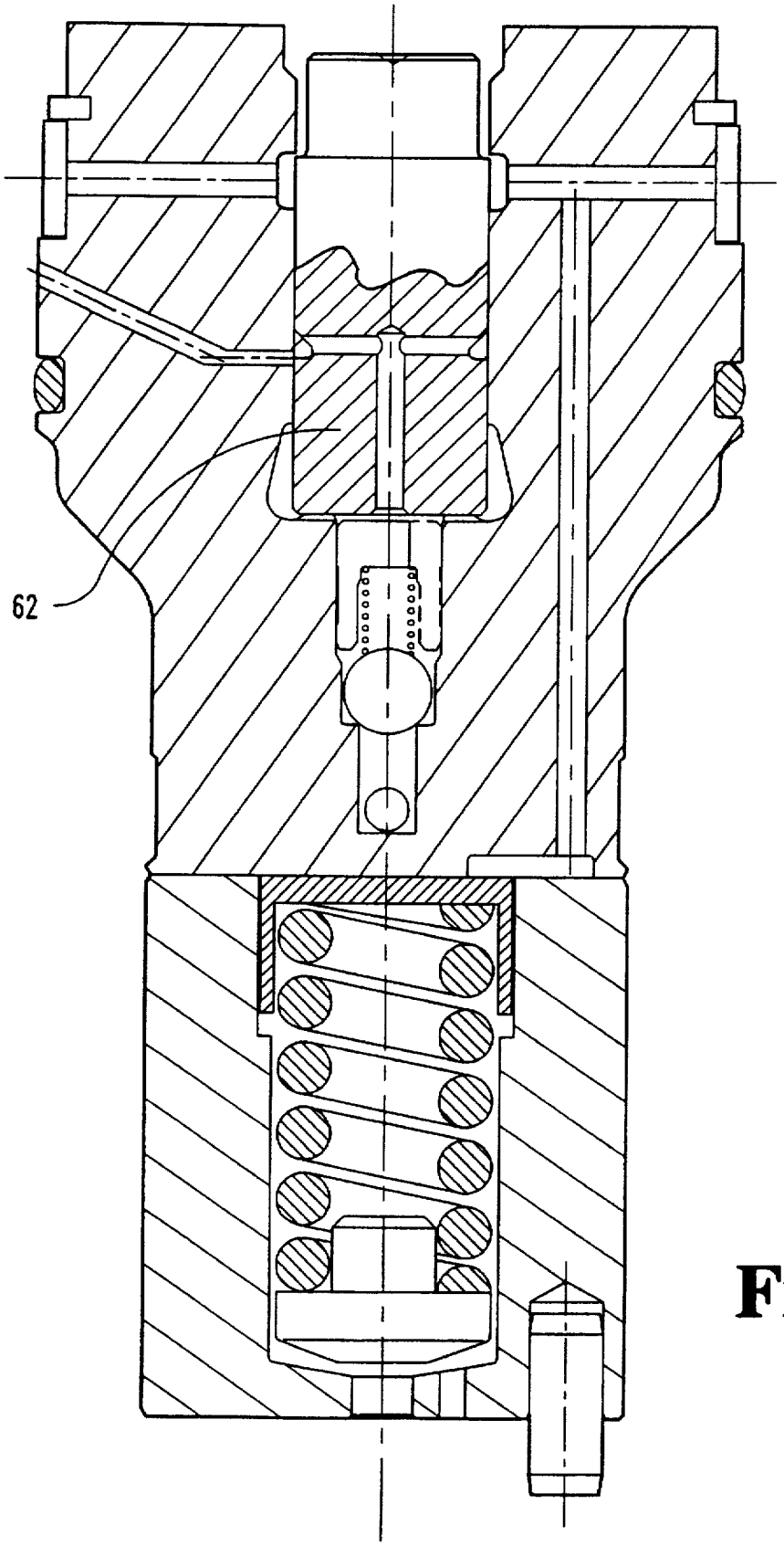
FIG. 9 is a view similar to FIG. 7 but showing a still further embodiment using the ring valve but also employing positive venting feature.

Referring now to FIGS. 7, 8 and 9, a further alternative construction of the spill system is shown. In these examples, instead of using the passageway 47, orifice 48 and passageway 49 to spill from the area above the spring loading piston 41, timing fuel spill is taken directly through radial passageways from the metering barrel spill groove to ports in the outer wall of the metering barrel and which are closed by a valve ring. More specifically, and referring to FIGS. 7 and 8, the metering barrel 71 has the spill groove 72 therein from which radial passageways 73 and 74 extend to and open at the outer wall 76 above the flange 77 of the metering barrel. A passageway 78 extends from the lateral passageway 74 down to the top of the spring loading piston 41 as described in the previous embodiments. But instead of the external surface of the barrel being truly cylindrical at wall portion 76 as it is elsewhere, the surface at 76 is elliptical as best shown in FIG. 8. There is a circular ring 79 which is pressed down around this elliptical surface and retained in place by the snap ring 81. Ring 79 is pressed down onto the elliptical surface and seals closed the ends of passageways 73 and 74. The tightness of the ring 79 on the passageways determines how much pressure it takes to open them up for spilling fuel. This can be established such as to permit adequate spilling of fuel and yet limit the rate of spill similar to the manner in which the rate of spill in the previously described embodiments is achieved by selection of size of orifice 48, so that the spring loading function of piston 41 is achieved fully.

FIG. 9 shows the application of the spill ring valve to a positive venting metering barrel assembly.

It should be understood that the metering barrel and plunger assemblies of the various embodiments are receivable in the injector assembly in the same way as shown in FIGS. 1–4.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fuel injector assembly comprising:

an injector body;

a metering plunger in a bore in the body and cooperable with an end of the bore to form an injection fuel chamber in the bore;

a timing plunger in the bore and cooperable with the metering plunger to define a timing fuel chamber in the bore, the plungers being movable in the bore and relative to each other to enable varying the position and volume, respectively, of the timing fuel chamber in the bore;

an injector port at an end of the body for injection of fuel from the injector into an internal combustion engine cylinder;

a passageway in the body for communicating injection fuel from the injection fuel chamber to the injection port;

an injector valve in the body and normally closing the passageway and having a first spring seat;

a spring seat piston in the body and having a second spring seat;

a valve closing spring normally compressed between the spring seats and holding the injector valve closed in the passageway;

the spring seat piston being movable in the body toward and away from the valve to thereby increase and decrease the compression force of the spring on the valve; and a timing spill passageway communicating between the metering plunger and the spring seat piston to load the piston with force derived from timing spill fuel pressure and further compress the spring and increase the valve closing force on the injector valve.

2. The assembly of claim 1 and wherein:

the spring seat piston is movable toward the valve by spill fuel pressure to increase the load on the spring to produce a valve closing force adequate to increase closing pressure to maintain a sharp end of injection even though opening pressure has been reduced to a level that normally would allow cylinder gases to backflow.

3. The assembly of claim 1 and further comprising:

a drain;

an internal passageway in the metering plunger having an entrance at the injection fuel chamber and an exit in a wall of the plunger; and a positive venting passageway in the body and having an entrance at the bore receiving the metering plunger and an exit to the drain;

the locations of the wall exit of the metering plunger and the bore entrance being located for communication between the exit and entrance when the metering plunger is moved to the injection fuel chamber end of the bore, to spill injection fuel to drain for decompression of injection fuel in the injection fuel passageway.

4. The assembly of claim 1 and wherein:

the injector valve is a needle valve.

5. The assembly of claim 1 and further comprising:

a piston stop in the injector body to limit piston travel toward the valve and thereby limit the force applicable to the injector valve by the spring.

6. The assembly of claim 5 and further comprising:

a drain;

flow control means associated with the piston and located between the metering plunger and the drain to maintain timing fuel spill pressure sufficient to drive the piston to the stop limit.

7. The assembly of claim 6 and wherein:

the flow control means include a ring valve on the injector body in a flow path between the metering plunger and the drain.

8. The assembly of claim 6 and wherein:

the timing spill passageway extends from the metering plunger to the spring seat piston to the drain; and the flow control means include a restriction in the passageway portion between the piston and the drain.

9. The assembly of claim 6 and wherein:

the metering plunger includes a longitudinally extending wall and an internal passageway having an entrance at the timing chamber and an exit in the wall; and the timing spill passageway has an entrance at the bore receiving the metering plunger;

the locations of the wall exit and bore entrance being located for communication between the exit and entrance when the metering plunger is moved to the injection fuel chamber end of the bore, to spill timing fuel from the timing fuel chamber through the internal passageway to the timing spill passageway.

10. In a diesel engine having a cylinder, a fuel injector nozzle with a port for injection of fuel into the cylinder, and an injector valve normally closing the port, a method of providing an injector nozzle closing pressure higher than opening pressure and comprising the steps of:

maintaining the valve closed by a spring-force only of a predetermined value prior to opening the valve for fuel injection into an engine cylinder;

increasing the spring force as the valve is opened for injection of fuel; and using timing fuel spill hydraulic pressure for maintaining the spring force greater than the predetermined value as the valve closes ending injection of fuel.

11. The method of claim 10 and wherein the step of maintaining the valve closed includes;

holding a spring coil compressed between a first seat located on the valve, and a second seat;

the step of increasing the force includes applying to an area of the valve, hydraulic pressure of fuel sufficient to move the valve toward the second seat and thereby further compress the spring; and the step of maintaining the force includes moving the second spring seat toward the first spring seat to further compress the spring.

12. The method of claim 11 and further comprising the step of:

providing decompression of injection fuel on the injector valve in the injector at the end of injection.

13. In a diesel engine having a cylinder, a fuel injector nozzle with a port for injection of fuel into the cylinder, and an injector valve normally closing the port, a method of providing an injector nozzle closing pressure higher than opening pressure and comprising the steps of:

maintaining the valve closed by a mechanical force of a predetermined value prior to opening the valve for fuel injection into an engine cylinder;

increasing the force as the valve is opened for injection of fuel; and maintaining a force greater than the predetermined value as the valve closes ending injection of fuel;

wherein the step of maintaining the valve closed further includes:

a) holding a spring coil compressed between a first seat located on the valve, and a second seat;, b) the step of increasing the force includes applying to an area of the valve, hydraulic pressure of fuel sufficient to move the valve toward the second seat and thereby further compress the spring; and c) the step of maintaining the force includes moving the second spring seat toward the first spring seat to further compress the spring, and wherein the step of moving the second spring seat includes applying hydraulic pressure to a piston to move the second spring seat.

14. The method of claim 13 and wherein:

the step of moving the second spring seat includes applying hydraulic pressure sufficient to prevent hydraulic injection pressures of fuel up to about 3,500 psi on said area from opening the valve.

15. The method of claim 13 wherein:

the step of applying hydraulic pressure to the piston includes spilling timing fuel for the source of hydraulic pressure to move the piston and thereby the second spring seat toward the first spring seat.

16. The method of claim 13 and further comprising the step of:

limiting movement of second valve seat total the first spring seat by a mechanical stop.

17. The method of claim 16 wherein:

the step of applying hydraulic pressure to the piston includes spilling timing fuel for the source of hydraulic pressure to move the piston and thereby the second spring seat toward the first spring seat.

18. The method of claim 17 and further comprising the step of:

limiting the rate of dissipation of timing fuel spill pressure to keep the second spring seat at the stop at the end of injection.

* * * * *

UNITED STATES PATENT AND TRADEMARK OFFICE
CERTIFICATE OF CORRECTION

PATENT NO. : 5,533,672

DATED : July 9, 1996

INVENTOR(S) : Lester L. Peters

It is certified that error appears in the above-identified patent and that said Letters Patent is hereby corrected as shown below:

Item [57] "ABSTRACT", line 1, delete "timing chamber", and following lines 2 through 6.

Column 1, line 15, change "Lo" to --to--.

Column 2, line 17, after "view of a" add --fuel--.

Column 2, line 29, after "parts at the" add --end--.

Column 2, line 42, after "restriction." add a return and indent to indicate a new paragraph before "FIG. 8".

Column 2, line 44, before "FIG. 9", add a return and indent to indicate a new paragraph.

Column 3, line 50, change "portions" to --portion--.

Column 3, line 57, delete "1".

Column 5, line 25, delete "seat".

Column 7, line 58 after "spring" delete the hyphen and add a space.

Signed and Sealed this

Eighth Day of October, 1996

*Attest:*

Bruce Lehman

BRUCE LEHMAN

*Attesting Officer*

*Commissioner of Patents and Trademarks*